US005423947A

United States Patent [19]

Steiner et al.

[11] Patent Number: 5,423,947

[45] Date of Patent: Jun. 13, 1995

[54] SEPARATING THE EDGE STRIP OF A PAPER WEB IN THE PRESS SECTION FROM THE WATER-IMPERMEABLE BELT

[75] Inventors: Karl Steiner, Herbrechtingen; Albrecht Meinecke, Heidenheim, both of Germany

[73] Assignee: Voith Sulzer Papiermaschinen GmbH, Heidenheim, Germany

[21] Appl. No.: 85,765

[22] Filed: Jul. 1, 1993

[30] Foreign Application Priority Data

Jul. 4, 1992 [DE] Germany ..... 42 22 034.3

[51] Int. Cl.[6] ..... D21F 7/00; D21F 3/00

[52] U.S. Cl. ..... 162/286; 162/194; 162/358.2

[58] Field of Search ..... 162/193, 194, 358.1, 162/358.2, 360.2, 360.3, 286, 353

[56] References Cited

U.S. PATENT DOCUMENTS

| | | | |
|---|---|---|---|
| 2,764,068 | 9/1956 | Sutherst | 162/193 |
| 3,556,936 | 1/1971 | Miyamoto | 162/286 |
| 4,483,745 | 11/1984 | Wicks et al. | 162/360.2 |
| 4,560,438 | 12/1985 | Tell et al. | 162/310 |
| 4,648,942 | 3/1987 | Wanke et al. | 162/286 |
| 4,943,351 | 7/1990 | Wedel | 162/205 |
| 5,037,509 | 8/1991 | Wedel | 162/286 |
| 5,178,732 | 1/1993 | Steiner et al. | 162/360.2 |
| 5,232,554 | 8/1993 | Kotitschke | 162/286 |
| 5,256,257 | 10/1993 | Schiel | 162/360.3 |

*Primary Examiner*—Karen M. Hastings
*Attorney, Agent, or Firm*—Baker & Daniels

[57] ABSTRACT

The invention is directed to a paper machine press section for dewatering a web. The press section includes at least one water and air impermeable belt for transfer or transport of the web, and a cutoff device for cutting off at least one edge strip from the transferred or transported web. At least one pickup device is provided for removing the cutoff strip from the belt. The pickup device is configured to effect a pivoting of the cutoff edge strip about two separate axes, whereby the cutoff edge strip is carried away generally sideways relative to and from the belt. In another embodiment, the water and air impermeable belt is replaced with a water and air impermeable roll.

10 Claims, 3 Drawing Sheets

SEPARATING THE EDGE STRIP OF A PAPER WEB IN THE PRESS SECTION FROM THE WATER-IMPERMEABLE BELT

BACKGROUND OF THE INVENTION

1. Field of the Invention

The present invention concerns a press section of a paper machine.

2. Discussion of the Related Art

DE 40 25 021 A1 discloses a paper machine press section for dewatering a paper web, characterized by two mutually independent, endless and elastic press elements incapable of water absorption and passing the paper web, which with one of its sides alternately makes contact, through one or several press gaps in order to thereby ensure maximally equal properties on both sides of the paper web.

In other prior types of paper machines which instead of this water- and air-impermeable belt employ a wire, the edge strips of the paper web are cut off (for instance by water jets) from the web on the wire, so as to limit the web width. These edge strips can then be separated from the web as it is picked up from the wire by an edge suction pickup. The edge strips then travel on with the wire and, thus, can subsequently be run from the wire into the couch pit. In this context, reference is made to U.S. Pat. No. 5,256,257. Pick-up devices themselves have been described, e.g., in G 89 14 679. Concerned here is a pick-up scraper supported by blowing air in the pick-up operation.

This and similar prior methods for separating web and edge strips, however, cannot be used with the type of belt described above. While the transfer illustrated in the U.S. Pat. No. 4,943,351 shows a paper web transfer from a smooth and water-impermeable belt, what's illustrated here, though, is the transfer of the entire paper web to the drying section, and not the pickup of an edge strip into the couch pit, which proceeds under different conditions.

The problem underlying the present invention is to provide a device which enables the pickup of the edge strips from a water- and air-impermeable belt independently from the paper web.

SUMMARY OF THE INVENTION

The present invention provides a pickup device for a paper machine press section which removes a cut off edge strip from a water and air impermeable belt independently from the paper web.

The invention comprises, in one form thereof, a press section including at least one water and air impermeable belt for transfer or transport of the web, and a cut off device for cutting off at least one edge strip from the transferred or transported web. At least one pickup device is provided for removing the cut off strip from the belt. The pickup device is configured to effect a pivoting of the cut off edge strip about two separate axes, whereby the cut off edge strip is carried away generally sideways relative to and from the belt.

In another embodiment of the invention, the water and air impermeable belt is replaced with a water and air impermeable roll.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1A:
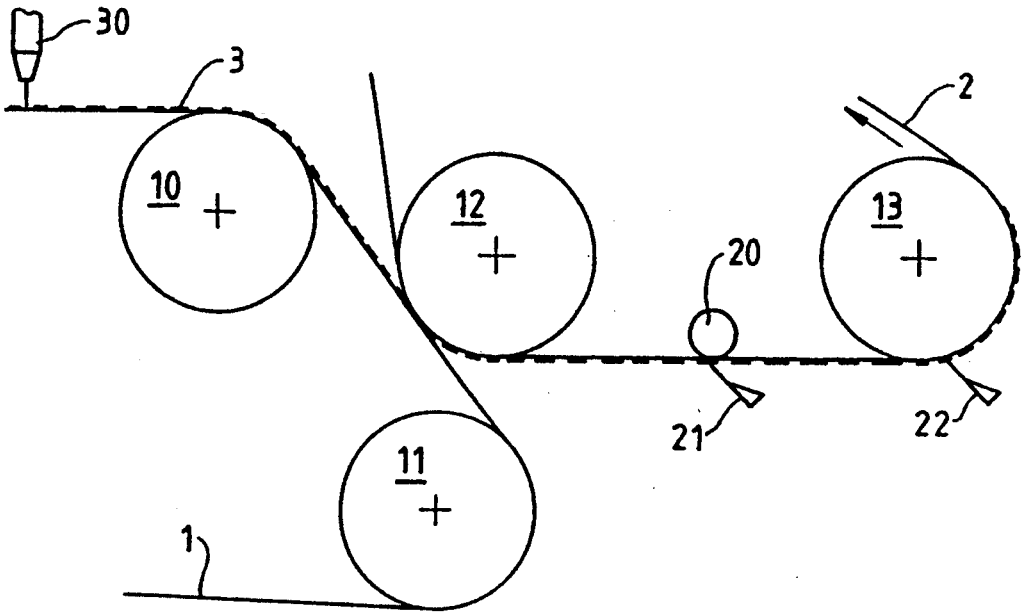
FIGS. 1A, 1B and 1C are diagrammatic views of a press section of a paper machine with edge strip removal by a scraper.

FIG. 1A shows a sectional view of a press section of a paper machine, in this case a transfer point of the paper from a belt, wire or felt onto a next belt. Illustrated is a belt, wire or felt 1 which, running from left to right, is over a first roll 10 deflected downward at a small wrap angle and restored again by a second roll 11. Disposed between the two rolls 10 and 11, on the other side of the felt 1, is a further roll 12 over which passes the belt 2 from above, in such a way that the roll forces belt 2 directly on felt 1 extending between rolls 10 and 11. Behind the point of contact with roll 12, belt 2 continues to run horizontally to another reversing roll 13 and proceeds from there upward. The paper web 3 carried on felt 1 is then transferred to belt 2, at the transfer point between rolls 10 and 11, and travels on with belt 2. Located between rolls 12 and 13 on the same belt side of rolls 12 and 13, as an example, is a roll 20 which bears down on the belt and serves as a backing roll for a pick-up device or edge scraper 21, which is arranged here in exemplary fashion and located on the paper side. Another option is illustrated by scraper 22 arranged on the paper side against roll 13. The function of the scrapers consists in lifting the edge strip of the paper, which previously has been separated by a cut-off device or trim shower 30, off web 3. In this case, trim shower 30 is arranged in exemplary fashion before roll 10. Of course, it is also possible to use a combination of the edge strip removal systems 20, 21 or 22 arranged in exemplary fashion.

Figure 1B:
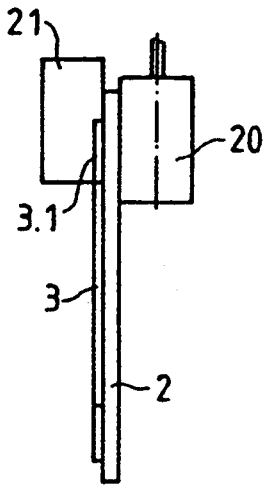

FIG. 1B shows a cross section through elements 20, 21 of FIG. 1A. Recognizable in the cross section is belt 2 with paper web 3 carried on it. Arranged in the outer area of belt 2 is a backing roll 20 with pertaining scraper 21, which picks edge strip 3.1 up from belt 2, while web 3 continues to be carried by belt 2.

Figure 1C:
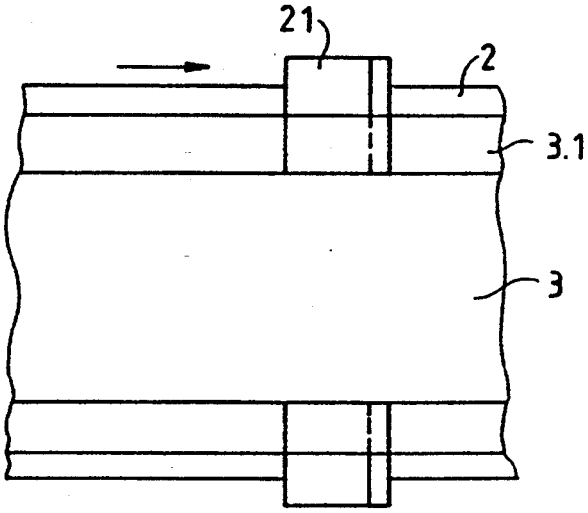

The same is shown in FIG. 1C in a plan view on the paper web 3 carried on belt 2. Recognizable, viewed from above, is the scraper 21 which lifts the edge strip 3.1 off paper web 3.

Figure 2A:
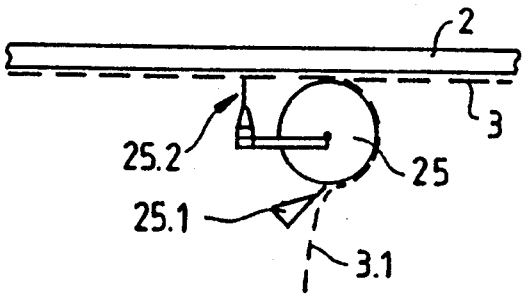
FIGS. 2*a*, 2*b* and 2*c* illustrate edge strip removal by a roll with a coupled trim shower.
Figure 2C:
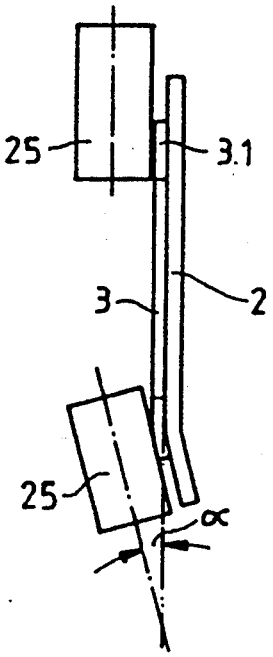
Figure 2B:
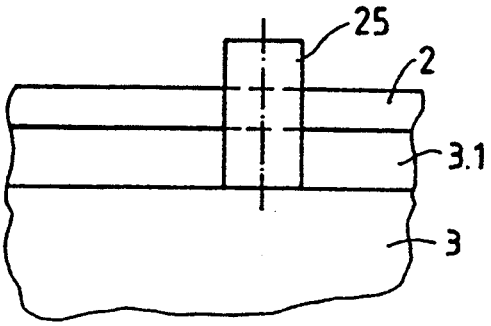

FIG. 2A shows a sectional view of a paper machine; in this case merely belt 2, in longitudinal section, with paper web 3 beneath it. A contact roll 25 bears down on the edge strip across its width, ensuring the liftoff of the edge strip from belt 2. Lifted edge strip 3.1 is then removed from roll 25 by a scraper 25.1, which is in direct contact with roll 25. Coupled directly, mechanically, with pick-up roll 25 is a trim shower 25.2. It is coupled to roll 25 in such a way that its cutting edge is always located exactly at the edge of roll 25, whereby the proper setting of roll 25 relative to trim shower 25.2 is always given. FIG. 2B shows the embodiment of FIG. 2A in plan view. FIG. 2C shows a sectional view of the embodiment shown in FIG. 2A, in a direction transverse to the web. Additionally shown, on the bottom end, is another variant to the effect that roll 25 is inclined relative to the plane of web 3 or belt 2 at an angle $\alpha$, whereby a sideways removal of edge strip 3.1 is assured. More particularly, edge strip 3.1 is pivoted about a first axis disposed coincident with the plane of web 3 (i.e., tilted relative to web 3) and a second axis defined by the axis of rotation of inclined roll 25. Roll 25 may have a smooth exterior surface which is smoother than the surface of belt 2.

Figure 3:
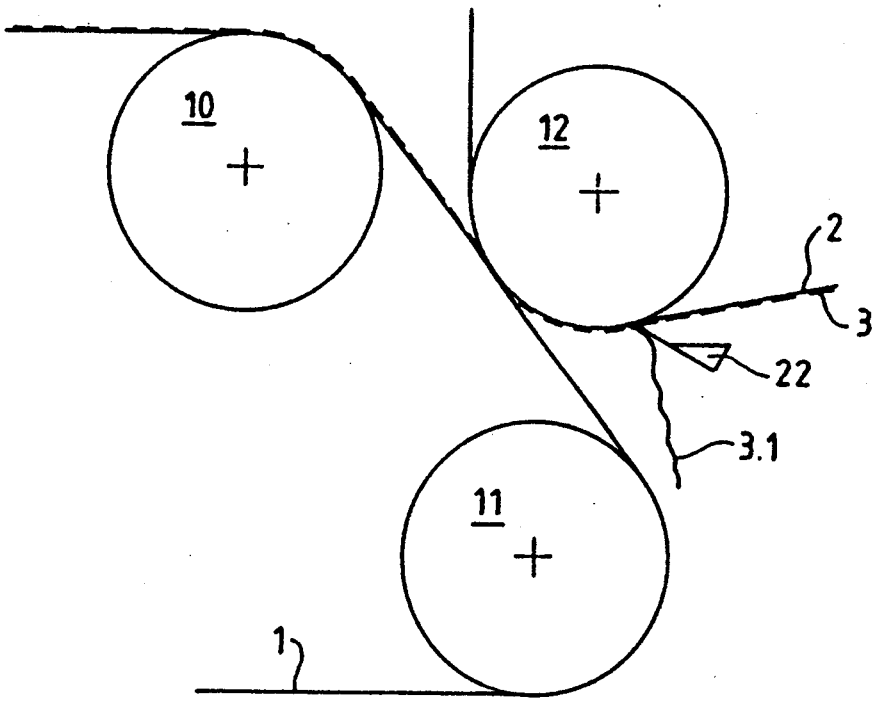
FIGS. 3 and 4 illustrate edge strip removal by means of scraper, directly on the reversing cylinder.

FIG. 3 shows a sectional view of a paper machine press section with an edge strip removal system. Coming from the left, a belt or felt 1 travels over a roll 10, down and to the right at an angle of about 45°, and returns via a further roll 11. Contained on felt 1 is a paper web 3, which between rolls 10 and 11 is picked up by a roll 12 situated on the other side. Wrapping around roll 12, coming from above, is a jacket 2 onto which paper web 3 is transferred in the area of contact with felt 1. Provided at the end of the wrap area of jacket 2 around roll 12 is a scraper 22, on the paper side, which with the roll 12 acting as backing roll scrapes the edge strip 3.1 off the jacket 2. Scraping the edge strip off in this area is especially favorable, since edge strip 3.1—immediately after the transfer point—bears relatively loosely on jacket 2.

Figure 4:
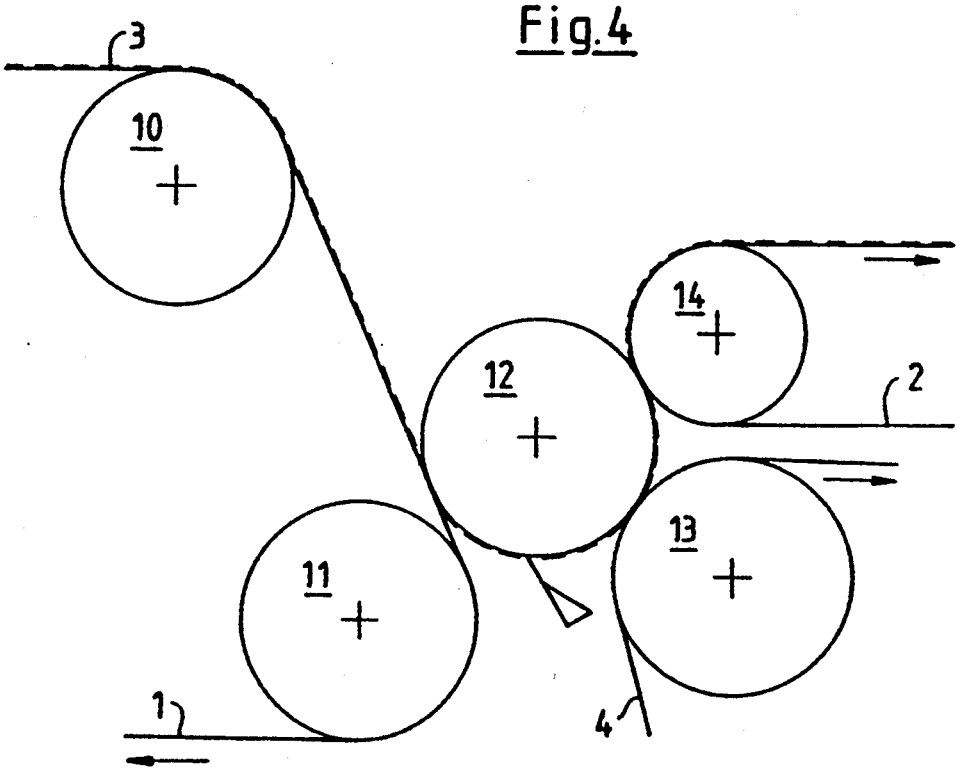

FIG. 4 shows as well a section of a paper machine press section. It illustrates a wire coming from the left and being deflected across a roll 10, downward to a further roll 11, whence it returns again. Carried on wire 1 is paper web 3. Shortly before roll 11, paper web 3 is picked up by another roll 12, which bears down on wire 1 on paper web 3 side, and is passed on roll shell to a press gap formed by a backing roll 13 with a felt 4 wrapping around it. After the press gap, paper web 3 continues to cling to roll 12 and is picked up, approximately on the opposite side of the first pick-up point, by a belt 2 which with the aid of a roll 14 is moved onto the shell of roll 12. Located in the area of roll 12, between paper pick-up point and press gap with roll 13, is a scraper which scrapes the previously trimmed edge strip directly off roll 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine press section for dewatering a web, comprising:

at least one water and air impermeable belt for transport of the web;

a cut-off device for cutting off at least one edge strip from said web;

at least one pick-up device for removing said cut off edge strip from said belt, said pick-up device comprising a narrow pick-up roll having length in a longitudinal direction thereof which is less than a width of said impermeable belt, said pick-up roll configured to effect a pivoting of said cut off edge strip about two separate axes, said pick-up roll defining an axis disposed at an angle $\alpha$ relative to said belt, whereby said cut off edge strip is carried away generally sideways relative to and from said belt, said pick-up roll having a surface in contact with said web and being mechanically connected to said cut off device.

2. The press section of claim 1, wherein said pick-up roll has a smooth exterior surface.

3. The press section of claim 2, wherein said pick-up roll has an exterior surface which is smoother than the surface of said belt.

4. The press section of claim 1, wherein said pick-up roll has an exterior surface which is smoother than the surface of said belt.

5. The press section of claim 1, further comprising means for damping the surface of said pick-up roll.

6. The press section of claim 5, wherein said damping means comprises a scraper against said pick-up roll for scraping off said cut off edge strip.

7. The press section of claim 1, further comprising a scraper disposed against said pick-up roll for scraping off said cut off edge strip from said pick-up roll.

8. The press section of claim 1, wherein said web comprises a paper web.

9. The press section of claim 1, wherein said cut off device comprises a trim shower.

10. The press section of claim 1, wherein said cut off device comprises a knife.

* * * * *